US005657035A

United States Patent [19]

Miyazaki

[11] Patent Number: 5,657,035

[45] Date of Patent: Aug. 12, 1997

[54] PLASMA ADDRESSED LIQUID CRYSTAL DISPLAY DEVICE OPERABLE UNDER OPTIMUM LINE SEQUENTIAL DRIVE TIMING

[75] Inventor: Shigeki Miyazaki, Kanagawa, Japan

[73] Assignee: Sony Corporation, Tokyo, Japan

[21] Appl. No.: 334,370

[22] Filed: Nov. 3, 1994

[30] Foreign Application Priority Data

Nov. 5, 1993 [JP] Japan ..... 5-301335

[51] Int. Cl.[6] ..... G09G 3/28

[52] U.S. Cl. ..... 345/60; 345/87

[58] Field of Search ..... 345/60, 84, 87

[56] References Cited

U.S. PATENT DOCUMENTS

| | | | |
|---|---|---|---|
| 4,896,149 | 1/1990 | Buzak et al. | 345/60 |
| 5,077,553 | 12/1991 | Buzak | 345/87 |
| 5,272,472 | 12/1993 | Buzak . | |
| 5,361,080 | 11/1994 | Kwon | 345/60 |
| 5,400,046 | 3/1995 | Ilcisin et al. | 345/60 |
| 5,408,226 | 4/1995 | Kwon | 345/60 |
| 5,408,245 | 4/1995 | Kakizaki | 345/60 |

FOREIGN PATENT DOCUMENTS

| | | | |
|---|---|---|---|
| 0 554 851 | 8/1983 | European Pat. Off. | G02F 1/133 |
| 0 500 084 | 8/1992 | European Pat. Off. | G09G 3/20 |
| 0 545 569 | 6/1993 | European Pat. Off. | G11C 11/22 |
| 42 23 305 | 6/1993 | Germany . | |
| 1-217396 | 8/1989 | Japan . | |

OTHER PUBLICATIONS

Buzak, "Plasma Addressing for Flat-Panel Displays", *IEEE Circuits and Devices*, vol. 6, No. 5, Sep. 1990, pp. 14–17.

*Primary Examiner*—Richard Hjerpe
*Assistant Examiner*—Juliana S. Kim
*Attorney, Agent, or Firm*—Hill, Steadman & Simpson

[57] ABSTRACT

A plasma addressed liquid display device includes a liquid crystal chamber having row-shaped signal electrodes, and a plasma chamber having column-shaped discharge channels and overlapped on the liquid crystal chamber. A scanning circuit sequentially applies a selective pulse to a cathode within a pair of plasma electrodes so as to excite gas atoms filled into the discharge channels from the ground state to the metastable state, so that the line sequential scanning operation is carried out. A drive circuit sequentially applies a data pulse to each of the signal electrodes in synchronism with this line sequential scanning operation, so that a desirable image display is performed. The operations of the scanning circuit and the drive circuit are so controlled as to satisfy a predetermined time sequential relationship $t_1<t_2<t_3$. It should be noted that $t_1$ indicates a time instant when the release of the applied selective pulse is complete, $t_2$ denotes a time instant when the recovery of the gas atoms to the ground state is complete, and $t_3$ shows a time instant when the release of the applied data pulse is complete. By satisfying this time sequential relationship, no unnecessary DC bias voltage is applied to the liquid crystal chamber, and it is possible to prevent a display image from being burned.

3 Claims, 4 Drawing Sheets

PLASMA ADDRESSED LIQUID CRYSTAL DISPLAY DEVICE OPERABLE UNDER OPTIMUM LINE SEQUENTIAL DRIVE TIMING

BACKGROUND OF THE INVENTION

1. Field of the Invention

The present invention relates to a plasma addressed liquid crystal display device having a flat panel structure in which liquid crystal chambers are mutually overlapped on plasma chambers. More specifically, the present invention concerns an optimum technique of line sequential drive timing for a plasma addressed liquid crystal display device.

2. Description of the Prior Art

Referring now to FIG. 3, a general structure of the conventional plasma addressed liquid crystal display device will be briefly explained. It should be noted that the plasma addressed liquid crystal display device is disclosed in, for instance, Japanese Laid-open Patent Application No. 1-217396, corresponding to U.S. Pat. No. 5,077,553. As shown in this drawing, this liquid crystal display device includes a flat panel structure constructed of a liquid crystal chamber 101, a plasma chamber 102, and a common intermediate sheet 103 interposed between the liquid crystal chamber and the plasma chamber. The plasma chamber 102 is fabricated by employing a lower-sided glass substrate 104, and a stripe-shaped groove 105 is formed on a surface of the glass substrate 104. This groove 105 extends along, for example, a row direction of a matrix. The respective grooves 105 are tightly sealed by the intermediate sheet 103 to constitute discharge channels 106 which are individually separated from each other. Excitable gas atoms are filled into the tightly sealed discharge channels 106. A convex portion 107 for separating the adjacent grooves 105 has a role of a separating wall for sectioning the respective discharge channels 106. A pair of plasma electrodes 108 and 109 being positioned in parallel to each other are provided on a curved bottom portion of each of the grooves 105. These plasma electrodes function as an anode "A" and a cathode "K", which may excite gas atoms contained in the discharge channel 106 to be brought into the metastable state, so that plasma is produced. This discharge channel 106 becomes a unit of row scanning operation. On the other hand, the liquid crystal chamber 101 is constructed by employing an upper-sided glass substrate 110. This glass substrate 110 is positioned opposite to the intermediate sheet 103 via a predetermined space into which a liquid crystal layer 111 is held. On the inner surface of the glass substrate, a signal electrode D made of a transparent conductive film is formed in a stripe shape. This signal electrode D is positioned perpendicular to the discharge channel 106, and constitutes a unit of a column signal. A matrix-shaped liquid crystal pixel is defined at an intersecting portion between the column signal unit and the row scanning unit.

In the plasma addressed liquid crystal display apparatus with the above-described structure, the display drive operation is carried out by switching/scanning the display channels 106 in the line sequential mode for performing plasma display, and by applying the data pulse to the signal electrode D located on the side of the liquid crystal chamber in synchronism with this scanning operation. As to this point, a small explanation will now be made with reference to FIG. 4. FIG. 4 schematically shows only two sets of liquid crystal pixels included in the plasma addressed liquid crystal display device indicated in FIG. 3. Each of the liquid crystal pixels 112 is arranged by a series connection between a plasma sampling switch S1 and a sampling capacitor constructed of a liquid crystal layer 111 sandwiched by the signal electrodes D1, D2 and the intermediate sheet 103. The plasma sampling switch S1 is equivalently represented with the function of the display channel. That is, when the display channel is activated, an internal portion thereof is connected to the anode potential over the substantially entire channel. On the other hand, when plasma discharge channel is complete, the discharge channel is at the floating potential. The data pulse is written via the sampling switch S1 into the sampling capacitor of the each liquid crystal pixel 112 to perform a so-called "sampling hold" operation. The turn-ON or turn-OFF of the respective liquid crystal pixels 112 can be controlled in the gradation manner by the voltage levels of the data pulse.

FIG. 5 is a waveform chart for representing a selective pulse applied to a cathode of a discharge channel, and a data pulse applied to a signal electrode. When a selective pulse having a predetermined negative voltage "Vs" via a cathode "K" of one discharge channel at certain selective timing, plasma discharge is produced within the discharge channel. The selective pulse is released after a predetermined time period has passed. At the time instant when the application of the selective pulse is released, the cathode potential is returned to a predetermined reference potential Vo and then the plasma discharge is accomplished. It should be noted that the anode "A" is always set to the reference potential Vo. Since the gas atoms excited by the plasma discharge is still under metastable state at the releasing time instant of the selective pulse, the lower surface of the intermediate sheet made of a thin glass plate becomes conductive with the anode and the cathode, and thus is at the reference potential Vo. As a result, the signal voltage "$V_{sig}$" of the data pulse is sampled at this releasing time instant of the selective pulse, and then a predetermined image signal can be written into the liquid crystal layer in accordance with the capacitance dividing ratio of the liquid crystal layer to the intermediate sheet. It should also be noted that the signal voltage "$V_{sig}$" of the data pulse is set based upon the above-described reference potential Vo. Soon, the gas atoms under metastable state are returned to the ground state, and the resistance within the discharge channel become high while a small stray capacitance portion remains, so that the image signal written into the liquid crystal layer is maintained until the subsequent selective timing.

As previously described, the signal voltage "$V_{sig}$" of the data pulse is set on the basis of the predetermined reference voltage Vo (anode potential). When the plasma discharge is produced, the potential at the lower surface of the intermediate sheet becomes substantially equal to the reference potential Vo (anode potential), and this signal voltage "$V_{sig}$" is sampled, whereby the correct image signal is written into the liquid crystal pixel. However, the potential at the lower surface of the intermediate sheet is not always stable, but may be varied in response to recovery from the metastable state of the gas atoms to the ground state. Conventionally, since the potential at the lower surface of the intermediate sheet is not correctly set to the ground potential during the sampling operation of the data pulse, unnecessary DC voltage components are applied to the liquid crystal layer. Accordingly, there is a problem that the image display burning happens to occur.

SUMMARY OF THE INVENTION

The present invention has been made in an attempt to solve the above-described problem, and therefore, has an object to provide a plasma addressed liquid crystal display apparatus capable of preventing such image display burning phenomenon. The plasma addressed liquid crystal display apparatus, according to one aspect of the present invention, is comprised of:

a liquid crystal chamber having a plurality of data electrode extending in a first direction;

a plasma chamber overlapped on said liquid crystal chamber and having an ionizable gas, said plasma chamber containing a plurality of plasma electrodes extending in a second direction different from said first direction, whereby a discharge channel is defined by a pair of said plasma electrodes;

a scanning circuit for sequentially applying a selective pulse to the plasma electrode contained in each of the discharge channels to excite gas atoms filled into said discharge channel from the ground state to the metastable state, thereby performing a line sequential scanning operation;

a drive circuit for sequentially applying a data pulse to the respective signal electrodes in synchronism with the line sequential scanning operation to display an image; and means for controlling said scanning circuit and said drive circuit so as to satisfy the below-mentioned time sequential relationship of: $t_1<t_2<t_3$, where symbol "$t_1$" denotes a time instant when a release of the applied selective pulse is complete, symbol "$t_2$" indicates a time instant when a recovery to the ground state of the excited gas atoms is complete, and symbol "$t_3$" shows a time instant when a release of the applied data pulse is accomplished.

With this arrangement, it is featured that the above-described scanning circuit and drive circuit are operated while satisfying a predetermined time sequential relationship of $t_1<t_2<t_3$. It should be understood that "$t_1$" indicates a time instant when a release of the applied selective pulse is complete, "$t_2$" represents a time instant when a recovery to the ground state of the excited gas atoms is complete, and also "$t_3$" denotes a time instant when a release of the applied data pulse is complete.

Preferably, the above-described scanning circuit includes complementary type selective pulse generating means in order that the time instant "$t_1$" when the release of the selective pulse is complete is made shorter than the time instant "$t_2$" when the recovery of the gas atoms is complete. Preferably, the above-mentioned discharge channels contain impurity gas atoms having a predetermined concentration so as to relatively adjust the time instant "$t_2$" when the recovery of the gas atoms is complete with respect to both the time instant "$t_1$" when the release of the selective pulse is complete, and the time instant "$t_3$" when the release of the data pulse is complete.

In accordance with the present invention, the timing control is carried out in such a manner that the recovery of the excited gas atoms to the ground state is accomplished with a small delay after the release of the applied selective pulse has been complete. In the actual writing operation, the image signal written at the time instant $t_2$ when the recovery of the gas atoms is complete is finally fixed. At this time, the release of the selective pulse has been previously accomplished, and thus the plasma electrodes contained in the discharge channel are returned to the reference potential for both of the anode "A" and the cathode "K" As a consequence, when the voltage of the written signal is fixed, no bias voltage is present at the discharge channel, and the correct writing operation is carried out on the basis of the reference potential. On the other hand, after the excited gas atoms have been recovered to the ground state, the release of the data pulse is complete. As a result, since the data pulse still maintains a predetermined signal voltage when the signal voltage is finally fixed, the correct writing operation is carried out.

BRIEF DESCRIPTION OF THE DRAWINGS

For a better understanding of the present invention, reference is made of the detailed description to be read in conjunction with the accompanying drawings, in which.

DETAILED DESCRIPTION OF THE PREFERRED EMBODIMENTS

Figure 1A:
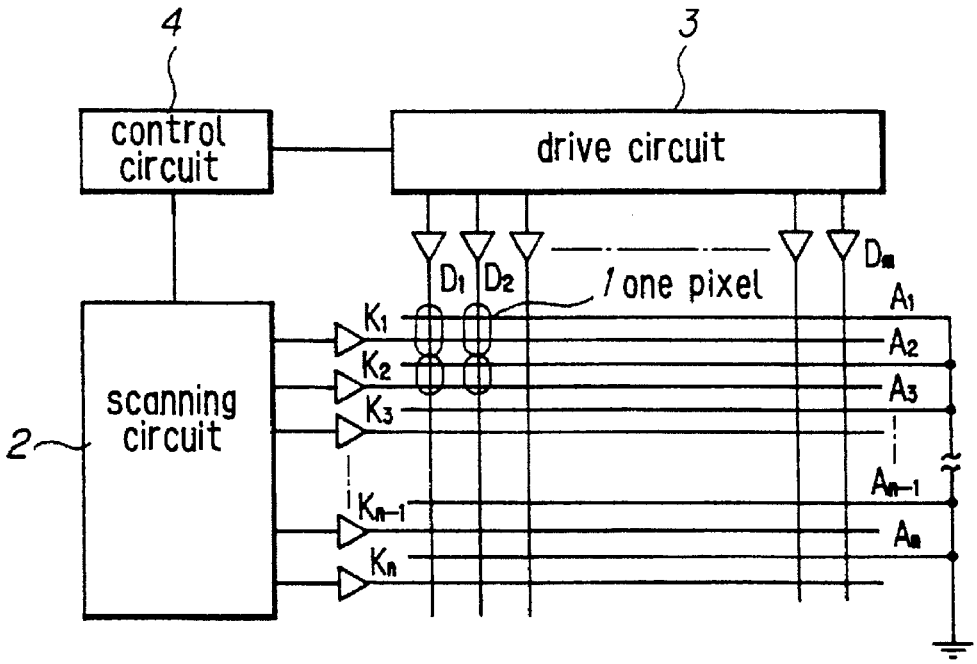
FIG. 1A is the equivalent circuit diagram chart of the plasma addressed liquid crystal display device according to the present invention.
Figure 1B:
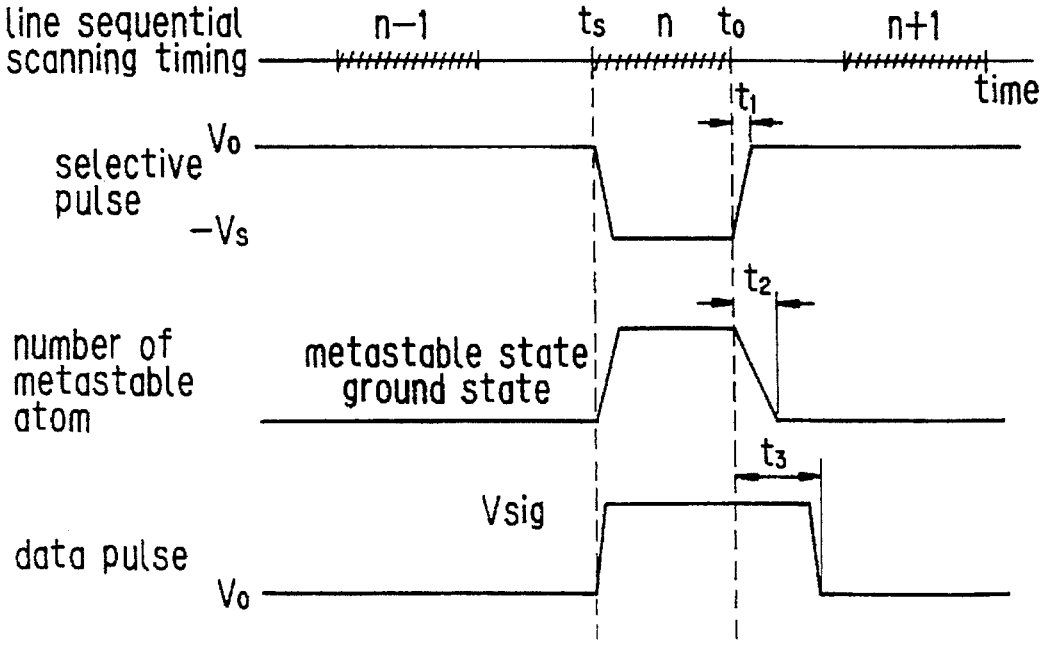
FIG. 1B is the operation waveform chart of the plasma addressed liquid crystal device of FIG. 1A.
Figure 3:
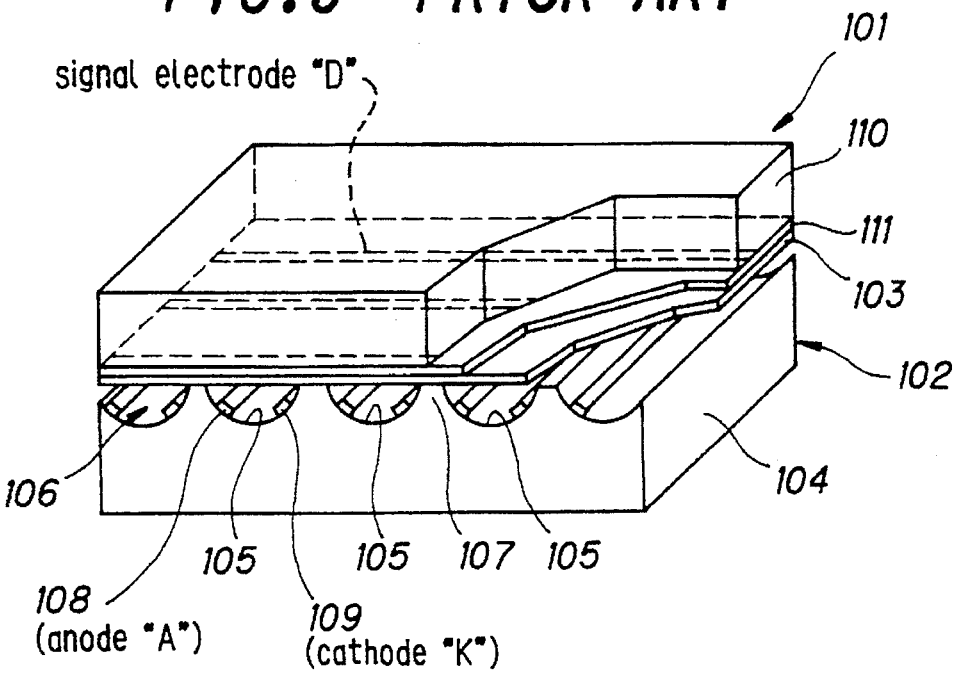
FIG. 3 PRIOR ART
FIG. 3 is a perspective view for representing the general structure of the conventional plasma addressed liquid crystal display device.
Figure 4:
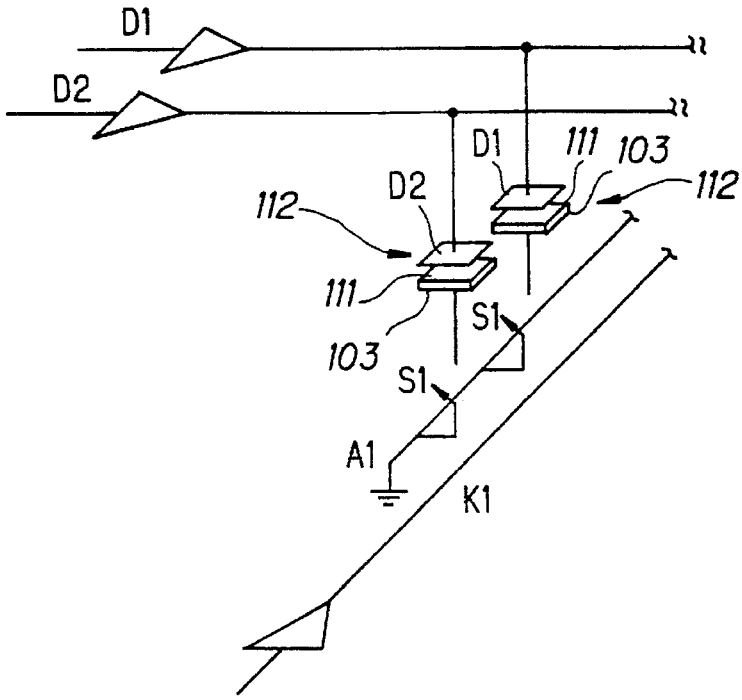
FIG. 4 PRIOR ART
FIG. 4 is the equivalent circuit diagram of the pixels contained in the plasma addressed liquid crystal display device shown in FIG. 3.
Figure 5:
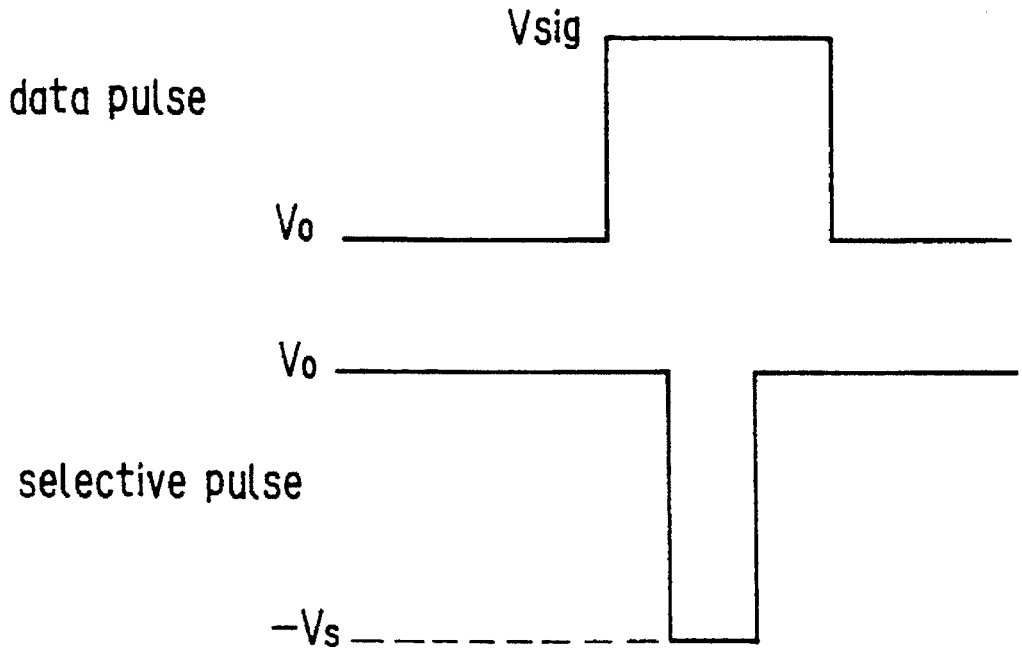
FIG. 5 PRIOR ART
FIG. 5 is the operation waveform chart of the conventional plasma addressed liquid crystal display device indicated in FIG. 3.

Referring now to drawings, a preferred embodiment of the present invention will be described in detail. In FIG. 1A, there are shown a circuit arrangement of a plasma addressed liquid crystal display device according to the present invention, and an operation waveform is shown in FIG. 1B. This liquid crystal display device basically comprises the stacked layer flat panel structure shown in FIG. 3, and is equipped with a liquid crystal chamber and a plasma chamber. As represented in an equivalent circuit diagram of FIG. 1(A), the liquid crystal cell is equipped with signal or data electrodes D1, D2, . . . , Dm arranged in a column shape. The plasma cell is equipped with discharge channels arranged in a row shape. Each of these discharge channels is constructed of one pair of anode "A" and cathode "K". The respective cathodes K1, K2, K3, . . . , $K_{n-1}$ and $K_n$ are successively arranged along the horizontal direction. The respective anodes A1, A2, A3, . . . , $A_{n-1}$ and $A_n$ are alternately arranged with respect to the cathodes, and all of which anodes are grounded at the reference potential Vo. Matrix-arranged pixels 1 are defined between the signal electrodes D arranged in the column shape and the discharge channels (K, A) arranged in the row shape. This liquid crystal display device further includes a scanning circuit 2 which applies selective pulses to the cathodes of the respective discharge channels in the line sequential scanning operation. As a consequence, gas atoms filled into the respective discharge channels are excited from the ground state into the metastable state. This liquid crystal display device also comprises a drive circuit 3. The drive circuit sequentially applies data pulses to the respective signal electrodes in synchronism with the line sequential scanning operation, so that a desirable image display is performed. These scanning circuit 2 and drive circuit 3 are mutually controlled in the synchronizing mode by a control circuit 4.

Subsequently, operations of the plasma addressed liquid crystal display device according to the present invention will now be described with reference to FIG. 1(B). FIG. 1(B) represents output timing of the selective pulse and the data pulse with respect to one pixel. As indicated in this drawing, the respective discharge channels are scanned in the line sequential mode at the timing of n−1, n, n+1. Giving now an attention to the n-th line sequential scanning timing, the application of the selective pulse is commenced at a predetermined timing "$t_s$", and the cathode potential is lowered from Vo to a predetermined negative potential Vs. After a predetermined selecting time period has passed, the release of the selective pulse is started at timing "$t_0$", and then the release of the selective pulse is accomplished at timing "$t_1$" after a delay time determined by a time constant of the circuit has elapsed. On the other hand, gas atoms filled within the selected discharge channel is excited from the ground state to the metastable state in conjunction with the application of the selective pulse. When the selective pulse is released after the selecting time period, the gas atoms under the metastable state start to be recovered to the ground state, and then the recovery of gas atoms is ended at timing "$t_2$" after a predetermined decay time has elapsed. As illustrated in this drawing, according to the present invention, such a timing control is carried out in such a manner that the time instant "$t_2$" when the recovery of the gas atoms is complete is later than the time instant "$t_1$" when the release of the selective pulse is complete. During the writing operation, the signal voltage written at the time instant "$t_2$" when the recovery of the gas atoms is complete, is finally fixed. At this time, the selective pulse has been previously released, so that the cathode is returned to the reference potential Vo (anode potential). As a consequence, there is no unnecessary DC bias voltage other than the reference potential within the selected discharge channel, and the liquid crystal chamber can be correctly driven in accordance with the reference potential. Accordingly, such a conventional problem that the display image is burned is not produced, and then a better display quality can be obtained, resulting in a long lifetime. On the other hand, the level of the data pulse is risen from the reference potential Vo to the signal voltage $V_{sig}$ in synchronism with the application of the selective pulse. The data pulse is fallen at timing "$t_3$" after a predetermined time period has elapsed, and the release of the data pulse is complete. This time instant "$t_3$" when the release of the data pulse is complete is set to be later than the time instant "$t_2$" when the recovery of the gas atoms is accomplished. When the signal voltage is fixed at the recovery complete time instant "$t_2$", the data pulse maintains the predetermined signal voltage $V_{sig}$, and the liquid crystal chamber can be correctly driven. As previously explained, when the operation timing of the scanning circuit 2 and the drive circuit 3 is controlled in order to satisfy such a preselected time sequential relationship $t_1<t_2<t_3$, no unnecessary DC bias voltage is applied to the liquid crystal layer, and the liquid crystal chamber can be correctly driven on the basis of the reference potential, so that better display qualities can be achieved.

Figure 2:
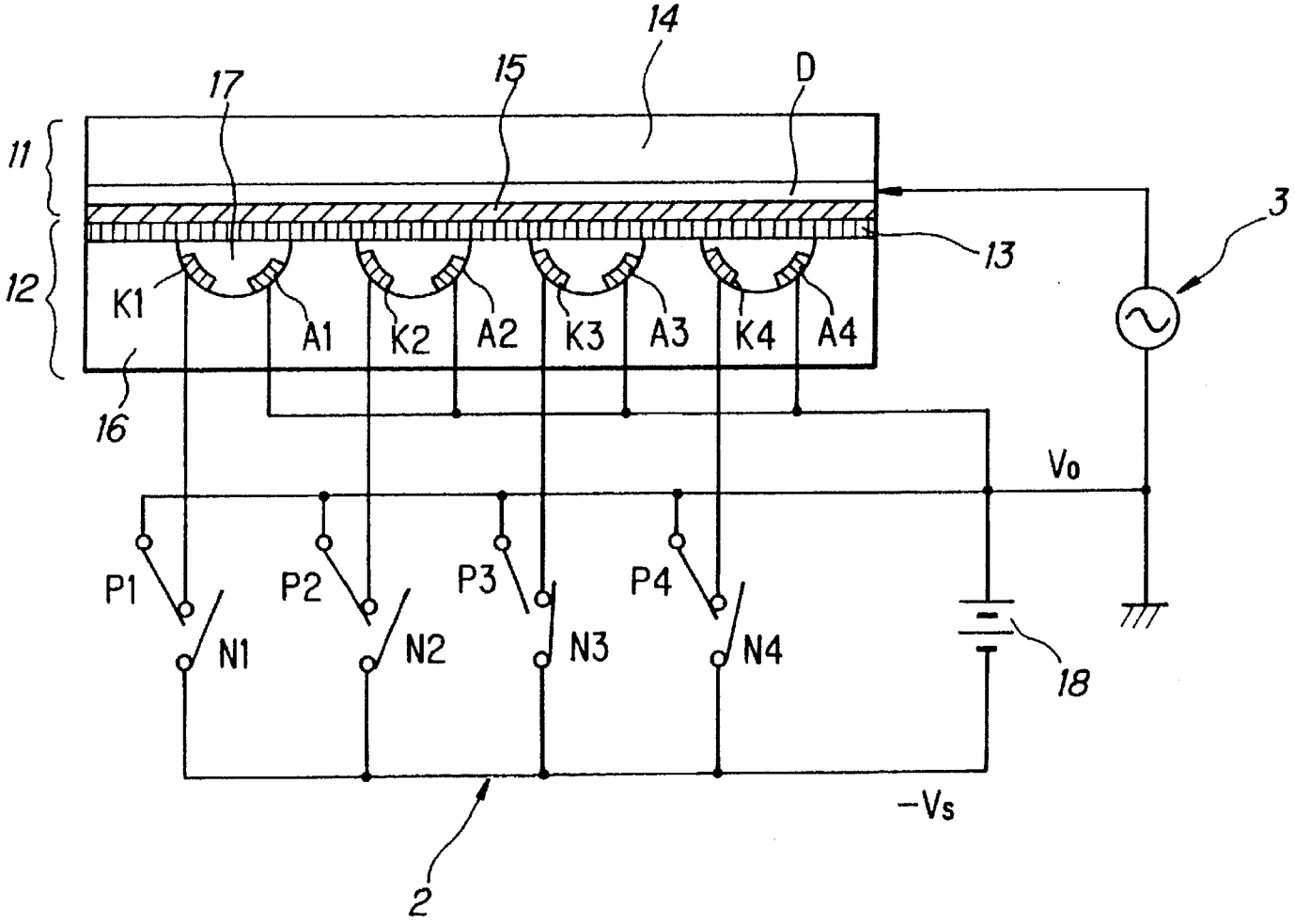
FIG. 2 is a schematic diagram for showing a concrete structural example of the plasm address liquid crystal display device indicated in FIG. 1.

Finally, FIG. 2 schematically represents a concrete structural example of the plasma addressed liquid crystal display device shown in FIG. 1. This display device owns a flat panel structure such that a liquid crystal chamber 11 and a plasma chamber 12 are mutually stacked via an intermediate sheet 13 in an integral form. The liquid crystal chamber 11 is constructed by employing an upper-sided glass substrate 14, and is attached via a predetermined space to the intermediate sheet 13. A liquid crystal layer 15 is filled into this space and sealed therein. A plurality of signal electrodes D formed in a stripe shape are provided on the inner surface of the glass substrate 14.

On one hand, the plasma chamber 12 is constructed by employing a lower-sided glass substrate 16. A plurality of grooves 17 is formed in a stripe shape on the inner surface of this substrate 16. The grooves 17 are intersected with the signal electrode D at a right angle, and each pair of anode/cathode electrodes A1/K1, A2/K2, A3/K3, A4/K4 are provided inside the grooves 17. The respective grooves 17 are sealed by the intermediate sheet 13 to constitute discharge channels separated from each other. Ionizable gas atoms are filled into the discharge channels. In this embodiment, since the time instant "$t_2$" when the recovery of the gas atoms to the ground state is complete is relatively adjusted with respect to the time instant "$t_1$" when the release of the selective pulse is complete, and the time instant "$t_2$" when the release of the data pulse is complete, the discharge channel contains impurity gas atoms with a predetermined concentration. In general, when an impurity gas atom other than the gas atom relevant to the plasma discharge, it is possible to shorten the time instant "$t_2$" the recovery of the impurity gas atom to the ground state is complete in accordance with concentration thereof. In case that pure helium is employed as the gas atom related to plasma discharge, for instance, decay time is on the order of 10 microseconds. When an impurity gas atom is added to this pure helium, the resultant decay time may be shortened up to approximately 1 microsecond, for instance, depending upon its concentration. As described above, the desired time sequential relationship of $t_1<t_2<t_3$ may be satisfied by properly controlling compositions of the gas filled into the discharge channels.

As previously stated, the drive circuit 3 is connected to each of the signal electrodes D, and a desired data pulse is supplied to the respective signal electrodes D. In this example, for an easy understanding of the drawings, the drive circuit 3 is schematically indicated as a signal source, and is grounded at a predetermined reference potential Vo. On the other hand, the scanning circuit 2 is connected to the pairs of anodes/cathodes A1/K1, A2/K2, A3/K3, and A4/K4, and applies to these pairs, such a selective pulse having a predetermined negative voltage Vs during each of selecting periods, for sequentially scanning the respective row discharge channels. To this end, a constant voltage source 18 is provided. In this embodiment, the scanning circuit 2 is equipped with a complementary type selective pulse generating means in order that the time instant "$t_1$" when the release of the selective pulse is complete is made shorter than the time instant "$t_2$" when the recovery of the gas atoms to the ground state is complete. Concretely speaking, one pair of complementary type switches P1/N1, P2/N2, P3/N3, P4/N4 are provided in correspondence with the respective cathodes K1, K2, K3, K4. These complementary type switches may be arranged by combining, for example, p-channel transistors and n-channel transistors. In the condition shown in this figure, the third discharge channel is selected, whereas the remaining discharge channels are under non-selective conditions. Under such non-selective conditions, the P-type switch is closed and the N-type switch is open. As a result, the cathode of the non-selected discharge channel is connected to the reference potential (anode potential) Vo. On the other hand, under the selective condition, the complementary type switches are operated in the complementary mode, i.e., the P-type switch is open and the N-type switch is closed. When the once applied selective pulse is released, the complementary type switch is instantaneously, again operated so that the P-type switch is closed and the N-type switch is open. The time instant may be shortened in this manner when the selective pulse is released, whereby a desirable time sequential relationship of $t_1<t_2<t_3$ can be realized.

While the present invention has been described above, the operation timing controls of the scanning circuit and the drive circuit are carried out in order to satisfy such a time sequential relationship as indicated by: the time instant "$t_1$" when the release of the selective pulse is complete < the time instant "$t_2$" when the recovery of the gas atoms to the ground state is complete < the time instant "$t_3$" when the release of the data pulse is complete. As a consequence, the liquid crystal chambers can be correctly driven in response to predetermined reference potentials, so that there are such advantages that no unnecessary DC bias voltage is applied and better display qualities can be obtained. Also, there is another merit that lifetime of the liquid crystal can be prolonged.

What is claimed is:

1. A plasma addressed liquid crystal display device comprising:

a liquid crystal chamber having a plurality of signal electrodes extending in a first direction;

a plasma chamber overlapped on said liquid crystal chamber and having an ionizable gas, said plasma chamber containing a plurality of plasma electrodes extending in a second direction different from said first direction, whereby a discharge channel is defined by a pair of said plasma electrodes;

a scanning circuit for sequentially applying a selective pulse to the plasma electrode contained in each of the discharge channels to excite gas atoms filled into said discharge channel from the ground state to the metastable state, thereby performing a line sequential scanning operation;

a drive circuit for sequentially applying a data pulse to the respective signal electrodes in synchronism with the line sequential scanning operation to display an image; and means for controlling said scanning circuit and said drive circuit so as to satisfy the below-mentioned time sequential relationship of: $t_1<t_2<t_3$, where symbol "$t_1$" denotes a time instant when a release of the applied selective pulse is complete, symbol "$t_2$" indicates a time instant when a recovery to the ground state of the excited gas atoms is complete, and symbol "$t_3$" shows a time instant when a release of the applied data pulse is accomplished.

2. A plasma addressed liquid crystal display device as claimed in claim 1 wherein said scanning circuit includes a complementary type selective pulse generating circuit whereby the time instant "$t_1$" when the release of the selective pulse is complete is made shorter than the time instant "$t_2$" when the recovery of the gas atoms is complete.

3. A plasma addressed liquid crystal display device as claimed in claim 1 wherein said discharge channels contain impurity gas atoms having a predetermined concentration so as to relatively adjust the time instant "$t_2$" when the recovery of the gas atoms is complete with respect to both the time instant "$t_1$" when the release of the selective pulse is complete, and the time instant "$t_3$" when the release of the data pulse is complete.

* * * * *